United States Patent [19]

Pardoe

[11] 4,277,968

[45] Jul. 14, 1981

[54] FORMING OF MATERIALS BY EXTRUSION

[75] Inventor: John A. Pardoe, Lytham St. Annes, England

[73] Assignee: United Kingdom Atomic Energy Authority, London, England

[21] Appl. No.: 883,663

[22] Filed: Mar. 6, 1978

[30] Foreign Application Priority Data

Mar. 16, 1977 [GB] United Kingdom ..... 11042/77
Nov. 29, 1977 [GB] United Kingdom ..... 49691/77

[51] Int. Cl.[3] ..... B21C 23/22; B21C 23/30; B21C 23/02; B21C 25/02

[52] U.S. Cl. ..... 72/262; 72/258; 72/269; 72/261

[58] Field of Search ..... 72/253, 259, 261, 262, 72/264, 270, 268, 269

[56] References Cited

U.S. PATENT DOCUMENTS

| | | | |
|---|---|---|---|
| 1,177,098 | 3/1916 | Garretson | 72/259 |
| 1,301,882 | 4/1919 | Stratton et al. | 72/259 |
| 1,984,775 | 12/1934 | Swartz | 72/268 |
| 2,018,217 | 10/1935 | McNamee | 72/268 |
| 2,181,987 | 12/1939 | Beaver et al. | 72/259 X |
| 2,367,394 | 1/1945 | Griffiths | 72/259 X |
| 2,991,877 | 7/1961 | Knapp et al. | 72/259 |
| 3,095,089 | 6/1963 | Bouton et al. | 72/268 |
| 3,765,216 | 10/1973 | Green | 72/262 |
| 3,922,898 | 12/1975 | Voorhes | 72/262 X |
| 4,044,587 | 8/1977 | Green et al. | 72/262 X |
| 4,061,011 | 12/1977 | Green | 72/262 |
| 4,163,377 | 8/1979 | Moreau | 72/262 X |
| 4,217,852 | 8/1980 | Nagai et al. | 118/405 |

FOREIGN PATENT DOCUMENTS

| | | | |
|---|---|---|---|
| 794495 | 5/1958 | United Kingdom | 72/259 |
| 1370894 | 10/1974 | United Kingdom | 72/262 |
| 1434201 | 5/1976 | United Kingdom | 72/262 |

*Primary Examiner*—Lowell A. Larson
*Attorney, Agent, or Firm*—Larson, Taylor and Hines

[57] ABSTRACT

Apparatus for the continuous forming of material by extrusion and having a rotatable wheel member with an endless groove therein, a stationary shoe member overlying part of the length of the groove and having a portion which projects into said part of the length of the groove and is of a width substantially equal to that of the groove so as to form a passageway therewith, a stationary abutment member associated with the shoe member and projecting into the groove so as to block the downstream end of the passageway, is characterized by the improvement that the wheel member has one or more endless grooves in its periphery, arranged in parallel planes where more than one groove is provided, the shoe member has as many projecting portions as grooves, the or each projecting portion engages the or the respective groove, a duct leads from the passageway formed by the shoe member with the or each groove, through the or the respective projecting portion into a single chamber formed in the shoe member, and one or more die orifices extending from the chamber to the exterior of the shoe member.

7 Claims, 5 Drawing Figures

FORMING OF MATERIALS BY EXTRUSION

BACKGROUND OF THE INVENTION

This invention relates to the forming of materials by extrusion.

Commonly owned British Pat. No. 1,370,894 discloses and claims a process of and apparatus for the forming of materials by extrusion which can be performed continuously provided the feed material is fed in continuously. The said process in broad terms comprises the steps of feeding material into one end of a passageway formed between first and second members with the second member having a greater surface area for engaging the material to be extruded than the first member, said passageway having a blocked end remote from said one end and having at least one die orifice associated with said blocked end, and moving the passageway-defining surface of the second member relative to the passageway-defining surface of the first member in a direction towards the or each die orifice from said one end to said blocked end such that the frictional drag of the passageway-defining surface of the second member draws the material substantially in its entirety along the passageway and through the or each die orifice.

The apparatus referred to in the preceding paragraph in broad terms comprises movable and fixed members defining an elongate passageway therebetween, an abutment member arranged to project into and block the passageway, means defining at least one die orifice leading from the passageway and associated with the abutment member, means for continuously feeding material to be extruded into the passageway at a position spaced from the abutment member, the amount of the surface area of the passageway defined by the movable member being greater than the amount of the surface area of the passageway defined by the fixed member, whereby upon movement of the passageway-defining surface of the movable member relative to the passageway-defining surface of the fixed member, the material fed into the passageway is moved by frictional drag with the surface of the passageway in the movable member towards the abutment member and is thereby extruded substantially in its entirety through the or each die orifice.

A particular form of the said apparatus, disclosed in the said British Pat. No. 1,370,894, comprises a rotatable wheel member having an endless groove therein and constituting the movable member, a stationary shoe member overlying part of the length of the groove, forming a passageway therewith, and constituting the fixed member an abutment member associated with the shoe member and projecting into the groove and blocking one end of the passageway, and at least one die orifice associated with the abutment member or shoe member.

Described in commonly owned British Pat. No. 1,434,201 which is a Patent of Addition to said British Pat. No. 1,370,894, are improvements in the apparatus specified in the preceding paragraph. They include the improvement of the shoe member having a portion projecting into and extending over a length of the passageway in front of the abutment member and of a width substantially equal to that of the passageway. An apparatus so improved is referred to hereafter as "of the hereinbefore specified kind".

If it is desired to change the product size to one which has a dimension bigger than that of the largest dimension of the feed material (the wheel groove being of a size which can handle such size of material), an expedient can be adopted such as is disclosed in commonly owned co-pending British application No. 20120/74, the substance of which is incorporated in commonly assigned U.S. Pat. No. 4,044,587 of Aug. 30, 1977, that is, the passageway has its cross-sectional area changed along its length in the direction from the inlet end thereof to the extrusion die end thereof in a manner such that the cross-sectional area of the passageway is greater at the die end than at the inlet end thereof, so that shape deformation of the feed material occurs during the passage of the material along the passageway, and this allows for extruding to a larger dimension than a dimension of the feed material.

Whilst these expedients are effective, it is nevertheless necessary in practice to employ feed material which is not much less in dimension than that of the product, where an increase in dimension is required. This means in effect that in order to obtain significant variations in product size, a range of feed material sizes have to be used together with a corresponding number of groove sizes, which means employing separate extrusion machines, or changing a wheel to one with a different groove, and changing the shoe member, the abutment member, and the die orifice to suit the new groove size.

In practice, feed materials are produced in very few standard sizes, and it is an object of the present invention to provide apparatus which can be used to produce a variety of product sizes, whilst needing to employ a very small number of machine variants, preferably as few as one only, and employing a standard size of feed material or a minimum number of standard sizes.

SUMMARY OF THE INVENTION

According to the present invention, apparatus of the hereinbefore specified kind for the forming of materials by extrusion has its wheel member constructed with one or more endless grooves in the wheel periphery and arranged, where more than one groove is provided, in parallel planes, its shoe member having as many projecting portions as grooves, the or each portion being adapted partially to engage the or the respective groove, a duct leading from the passageway formed by the shoe member with the or each groove, through the or the respective projecting portion into a single chamber formed in the shoe member, and one or more die orifices extending from the chamber to the exterior of the shoe member.

The or one or more of the die orifices extending from the chamber can extend radially outwardly relative to the said wheel member and be a multi-die orifice; alternatively there may be a die orifice extending out of the said chamber in one direction parallel to the axis of the said wheel member, or there may be two die orifices extending out of the said chamber in opposite directions both parallel to the said axis; and as a further alternative there may be one die orifice extending out of the said chamber in a direction parallel with the said axis together with a sealed inlet in the same direction for material which forms the core for clad- or co-extrusion through the said die orifice.

DESCRIPTION OF THE DRAWINGS

Constructional examples involving the said variants will now be described with reference to the accompanying diagrammatic drawings, in which.

DESCRIPTION OF THE PREFERRED EMBODIMENTS

Figure 1:
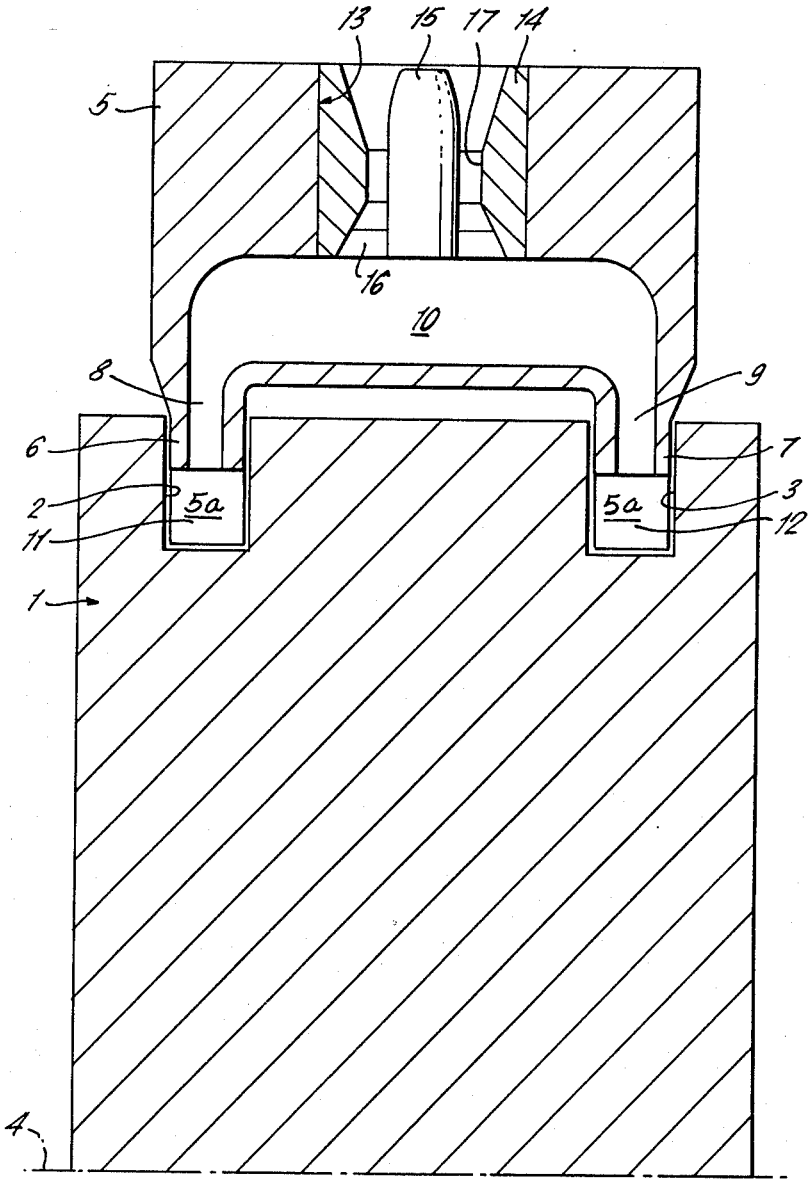
FIG. 1 is an end view in depth and in medial section of a first variant.

Firstly, reference is made to said British Pat. No. 1,370,894, in particular to FIG. 3 thereof, which, together with the appropriate description, sets forth the kind of extrusion apparatus, and its mode of operating, to which the present invention relates. The wheel 1 shown in the said FIG. 3 has a single groove 3 and the shoe member 4 overlies this groove over a portion thereof, forming a passageway blocked at one end by the abutment member 5 in which the die orifice 6 is formed. In the apparatus of the present invention, and referring now to FIG. 1 of the accompanying drawings (in which like reference numerals indicate like parts), the wheel 1, half of which is here shown in end view, medial section, has two grooves 2, 3 respectively, the grooves being in the periphery of the wheel 1 and lying in parallel planes normal to the wheel axis which is shown by dot-and-dash line 4. A single shoe member 5 is common to both grooves but has projecting parts 6, 7 which partially engage the grooves 2, 3 respectively. Commonly owned British Pat. No. 1,434,201 describes with reference to FIGS. 1 and 2 thereof, the improvement over the apparatus shown and described in the said British Pat. No. 1,370,894, namely that the shoe member has a part, integral or as an insert member, projecting partially into the groove of the wheel member, which leads to advantages which are set forth therein. The present embodiment includes this feature, and the parts 6, 7 though shown integral, can be separately formed and be secured to the main body of the shoe member 5.

The parts 6, 7 have ducts 8, 9 respectively extending from their outer ends to communicate with a single chamber 10 formed in the body of the shoe member 5. The ducts are disposed at the downstream end region of the shoe member 5, near to abutment members 5*a*, shown in background in FIG. 1 but not shown in the detached views of FIGS. 2–5, which abutment members are provided to block each groove at the downstream end of each passageway formed by the covered part of the grooves and the projecting parts of the shoe member 5. The passageways are designated 11, 12 in the drawing. The chamber 10 has an outlet 13 to the exterior of the shoe member 5 via a die which in this case is arranged radially relative to wheel 1. The die is provided as a replaceable unit 14 in the wall of shoe member 5, and the particular die illustrated is a die for tubular products and having a mandrel 15 supported by a spider 16 centrally in the die throat 17. For tubular dies such as the one illustrated or one of the porthole type, advantage stems from the fact that the force of flowing material on the mandrel (as illustrated) or other centrally disposed former is a balanced force the resultant of flow from two opposed directions.

Figure 5:
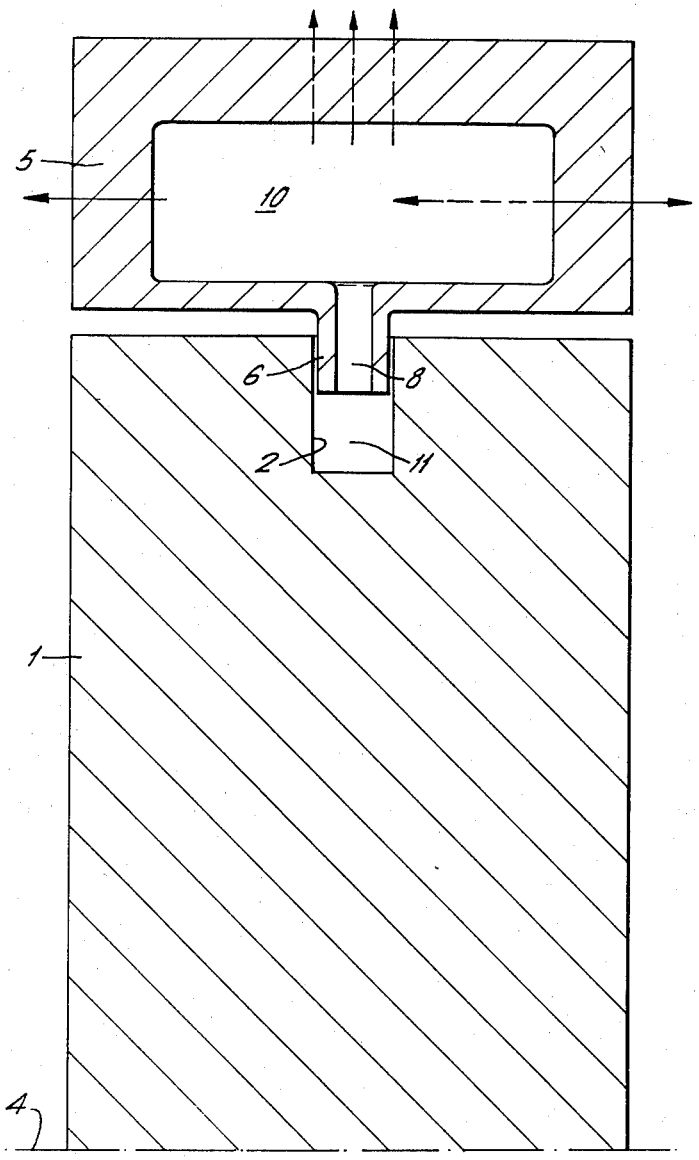

More than two grooves can be provided where particularly thick section products are required, or, see FIG. 5 and the relevant description, a single groove can be employed where a lower speed of production of products can be accepted.

Figure 2:
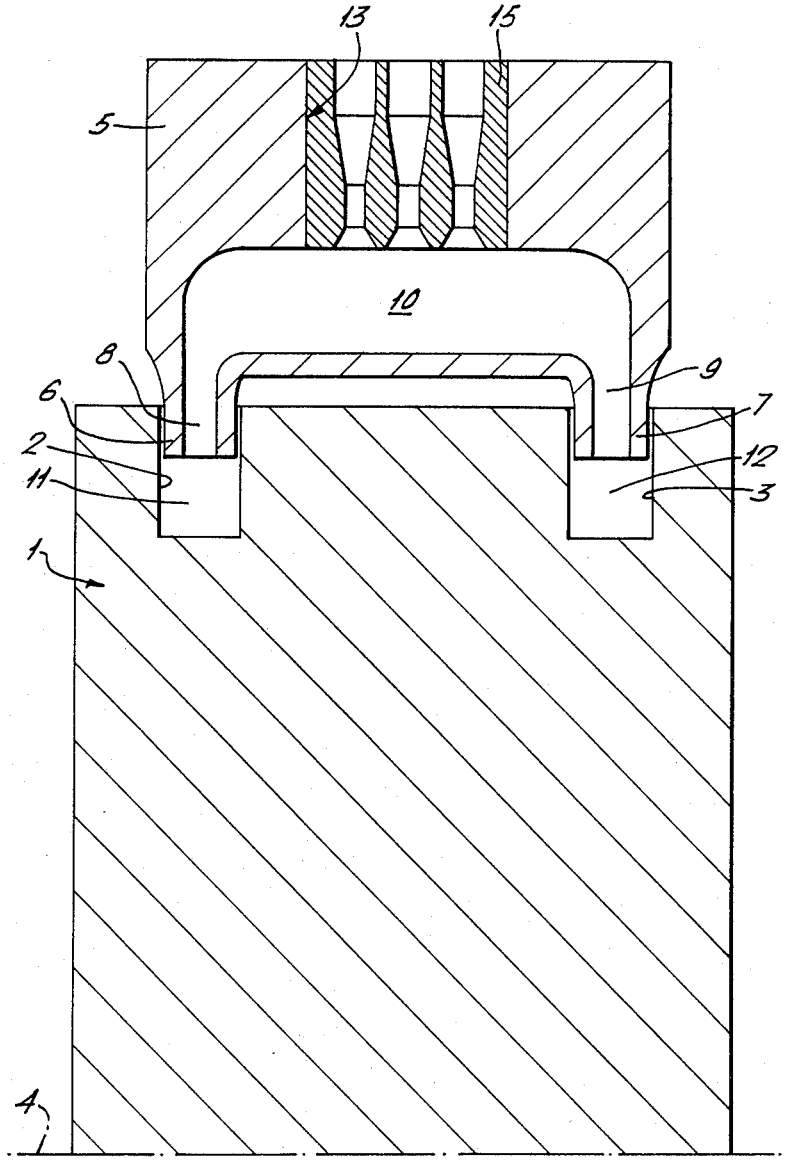
FIGS. 2–5 are similar views, but detached views so that background is not shown, each illustrating a further variant.
Figure 3:
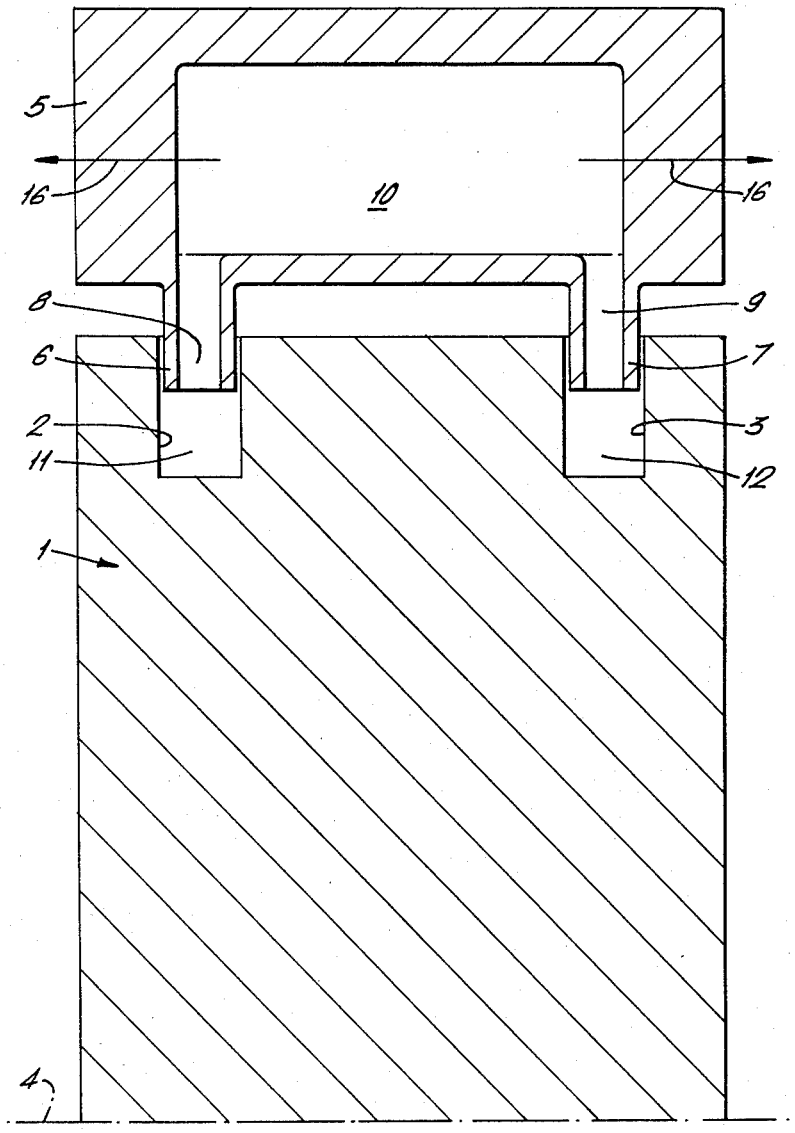
Figure 4:
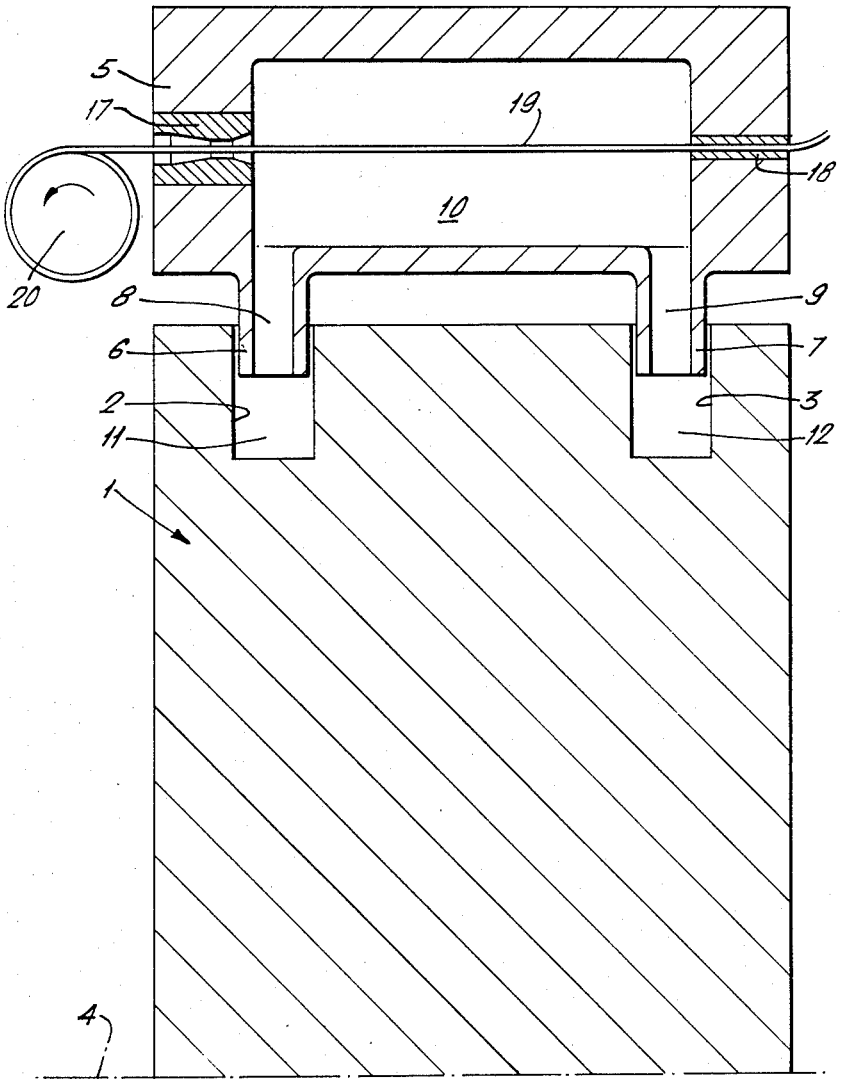

In FIGS. 2 to 4, the wheel 1, grooves 2 and 3, wheel axis 4, shoe member 5, projecting parts 6 and 7, ducts 8 and 9, chamber 10, passageways 11 and 12, and outlet 13 from the chamber 10, are similar to the corresponding parts illustrated in FIG. 1 hereof. Referring now to FIG. 2 of the accompanying drawing, the outlet 13 from chamber 10 to the exterior of the shoe member 5 is in this embodiment constituted by a multi-orifice die 15 arranged radially relative to wheel 1. The die 15 is provided as a replaceable unit in the wall of shoe member 5. This contrasts with the embodiment of FIG. 1, in which the die 14 was described and illustrated as a die for tubular products.

FIG. 3 illustrates a variant in die positioning relative to the chamber 10 and the wheel 1. Instead of being positioned in that wall of chamber 10 which provides the outlet from the chamber 10 to be in a radial direction, a die or dies 16 may be positioned in one or other of opposed walls of chamber 10, well above the parts 6, 7 which would make the outlet or outlets extend from the chamber 10 in a direction which is parallel to the axis 4 of wheel 1, and at right angles to the general plane in which the wheel 1 lies. The die or dies 16 may be or may each be a single orifice die, or a multi-orifice die. The position of the die or dies 16 is shown by arrows extending in opposed directions, both parallel with the wheel axis 4.

FIG. 4 illustrates another variant, in which the direction of extrusion is as in the FIG. 3 variant, ie parallel to the axis 4, but in this case provision is made for effecting co-extrusion, for example for providing aluminium or copper clad steel wire for high strength conductors. The co-extension die 17 is provided in one of the two positions similar to those shown by the arrows 16 in FIG. 3, and the opposed position is an inlet or entry 18 to the chamber 10 for a core material 19 (in the example given, steel wire) of a uniform diameter through which entry 18 the material 19 enters in a sealed manner, ie the entry orifice is a close fit on the material to avoid upset material within the chamber from extruding outwardly. The orifice of the co-extrusion die 17 is larger in diameter than the diameter of core material 19 by a selected amount, being equal to twice the required clad thickness. Feed of the core material for the co-extrusion can be caused solely by the extrusion pressure generated in the chamber 10, or can be augmented by pull on the co-extrusion for example by driving a collecting reel 20 with excess torque over that required merely for take-up. Reference to co-extrusion in the description with reference to FIG. 4 should be read as including clad-extrusion which can be effected with equal facility.

Finally, in FIG. 5, employment of a single grooved wheel 1 is illustrated. This can be employed with any suitable die or dies, for example as illustrated and described in any of FIGS. 1 to 4 hereof. This variant is particularly applicable where the speed of product is not required to be high, and can be accepted as a lower value than feed rate.

Further advantages arise from being able to employ a multiplicity of grooves of a size suitable for standard feedstock, eg $9\frac{1}{2}$ mm aluminium continuously cast rod, and because of the wide variety of product which can be produced by variation of die unit, because the chamber 10 provides a reservoir of upset material allowing products of larger dimension than the largest feed material dimension to be extruded.

I claim:

1. Apparatus for the forming of materials by extrusion, comprising a rotatable wheel member having an endless groove therein, a stationary shoe member overlying part of the length of the groove and having a portion which projects into said part of the length of the groove and is of a width substantially equal to that of the groove so as to form a passageway therewith, a stationary abutment member associated with the shoe member and projecting into the groove so as to block the downstream end of the passageway, characterised by the improvement that the wheel member has at least one endless groove in its periphery, arranged in parallel planes where more than one groove is provided, the shoe member has as many projecting portions as grooves, each projecting portion engaging a respective groove, a duct leading from the passageway formed by the shoe member with each groove, through the respective projecting portion into a single chamber formed in the shoe member, and at least one die orifice extending from the chamber to the exterior of the shoe member.

2. Apparatus according to claim 1, wherein said at least one die orifice extends from the said chamber radially outwardly relative to the wheel member.

3. Apparatus according to claim 2, wherein said at least one die orifice is a multi-die orifice.

4. Apparatus according to claim 1, wherein a die orifice extends from the said chamber in one direction parallel to the axis of the said wheel member.

5. Apparatus according to claim 1, wherein two die orifices extend from the said chamber in opposite directions both parallel to the axis of the said wheel member.

6. Apparatus according to claim 1, wherein one die orifice extends from the said chamber in a direction parallel to the axis of the wheel member, together with a sealed inlet extending into the said chamber in the same direction as the die orifice, for material forming the core for clad- or co-extrusion through the said die orifice.

7. Apparatus as claimed in claim 1 wherein said wheel member has at least two endless grooves arranged in parallel planes in its periphery, said shoe member has a corresponding number of projecting portions, each portion engaging a respective groove, and a duct leads from each passageway formed by the shoe member with each groove, through the respective projecting portion into said single chamber formed in the shoe member.

* * * * *